United States Patent [19]

Stackhouse

[11] 4,384,641

[45] May 24, 1983

[54] COIN LOCK WITH CUSTODIAN ACCESS

[75] Inventor: Wells F. Stackhouse, Leesburg, Fla.

[73] Assignee: American Locker Security Systems, Inc., Jamestown, N.Y.

[21] Appl. No.: 288,009

[22] Filed: Jul. 29, 1981

[51] Int. Cl.[3] ..... G07F 5/00

[52] U.S. Cl. ..... 194/92; 70/85

[58] Field of Search ..... 194/51, 54, 59, 92, 194/65; 70/85

[56] References Cited

U.S. PATENT DOCUMENTS

| | | | |
|---|---|---|---|
| 206,646 | 7/1978 | Towne . | |
| 845,020 | 2/1907 | Voight . | |
| 2,675,107 | 4/1954 | Garver | 194/54 |
| 2,707,043 | 4/1955 | Garver | 194/54 |
| 2,723,018 | 11/1955 | Strayer | 194/51 |
| 3,193,074 | 7/1965 | Stackhouse | 194/92 |
| 3,228,506 | 1/1966 | Stackhouse | 194/92 |
| 3,249,197 | 5/1966 | Smith et al. | 194/65 |
| 3,397,765 | 8/1968 | Smith | 194/59 |
| 3,450,244 | 6/1969 | Smith | 194/59 |
| 3,460,662 | 8/1969 | Kinoshita | 194/51 |
| 3,599,770 | 8/1971 | Stackhouse | 194/92 |
| 4,033,157 | 7/1977 | Williams | 70/85 |

*Primary Examiner*—Stanley H. Tollberg

*Attorney, Agent, or Firm*—Bean, Kauffman & Bean

[57] ABSTRACT

An improved coin operated lock unit and arrangement for mounting same is characterized in that the lock unit is removably mounted within a lock unit mounting post through a rear surface thereof, which is exposed for lock unit insertion/removal purposes only when the door of an adjacent storage compartment is in an unlocked condition; the mounting post having apertures in its front and side surfaces disposed for alignment with at least the key operated custodian and patron locks, the coin chute and the lock bolt of the lock unit, when disposed within the mounting post. Structure under the control of the custodian lock is employed to selectively, releasably retain the lock unit within the mounting post and to control the patron lock for door unlocking/locking purposes, while the patron key is removed from the patron lock.

9 Claims, 5 Drawing Figures

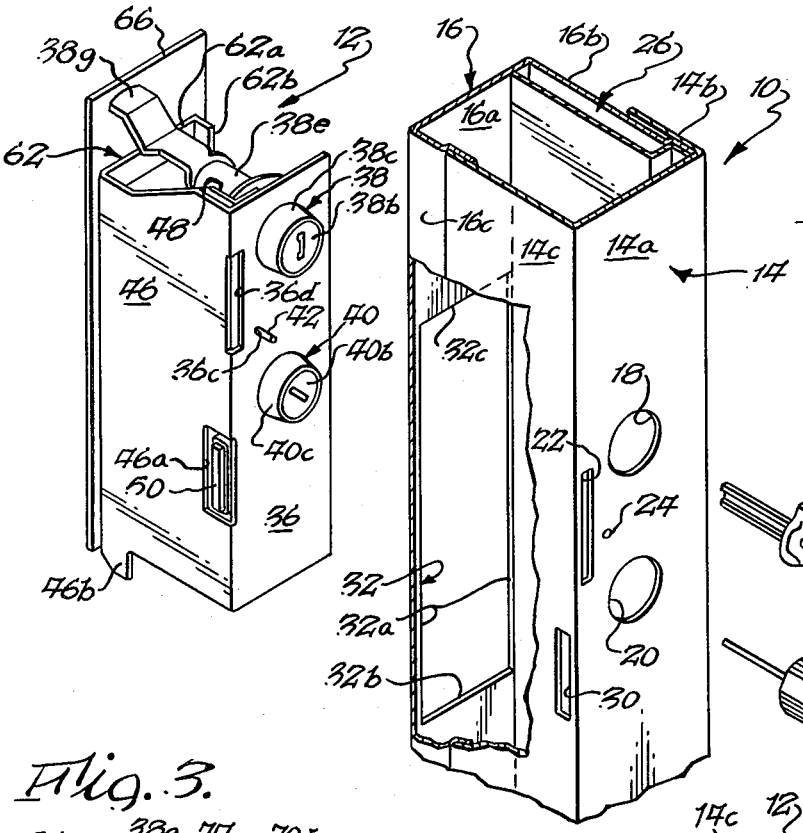
Fig. 1.
Fig. 2.
Fig. 3.
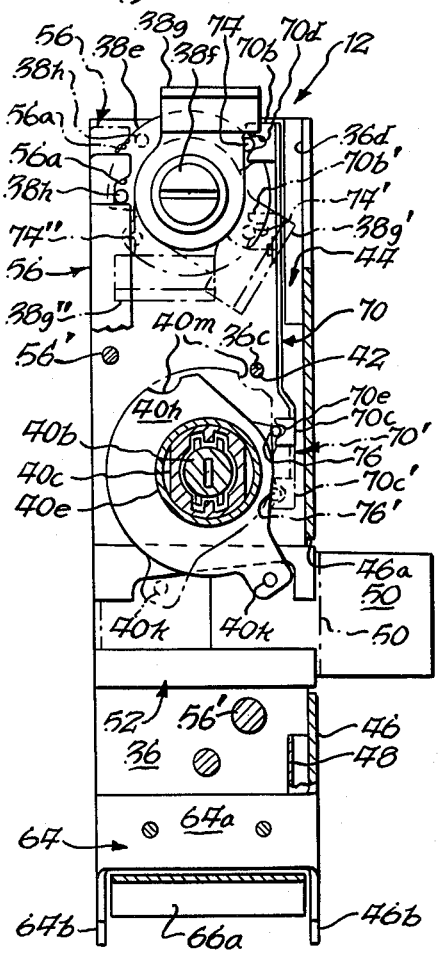
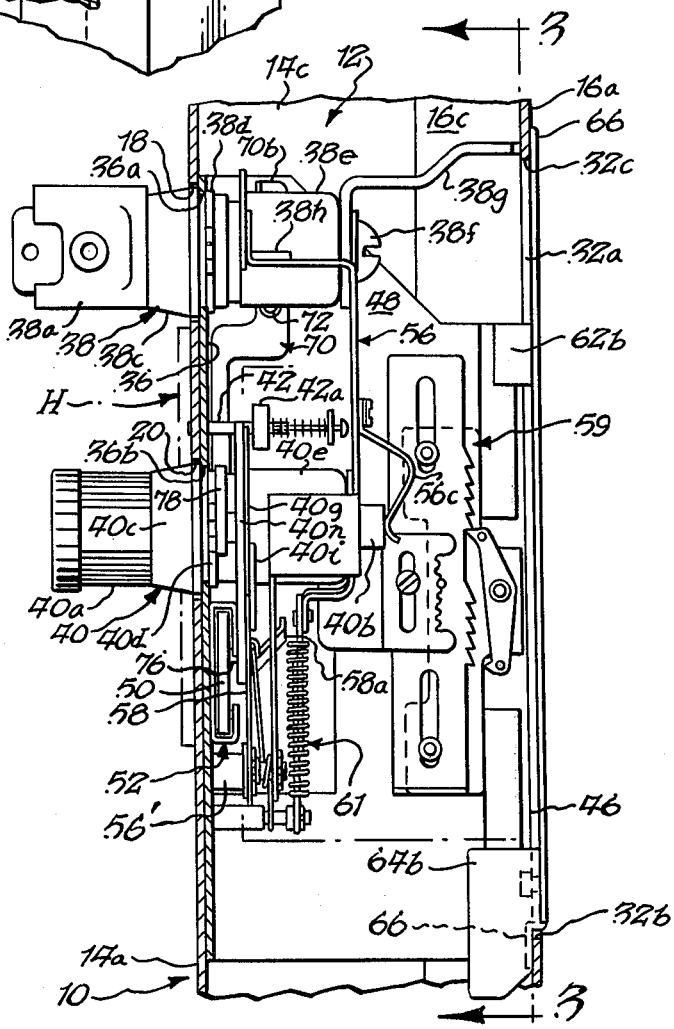

COIN LOCK WITH CUSTODIAN ACCESS

BACKGROUND OF THE INVENTION

The present invention is directed towards a solution of the problem heretofore present in coin operated locker cabinets involving the prevention of unauthorized opening of the locked doors of the cabinet by the expedient of gaining access to their associated coin operated lock units.

In typical commercially available locker cabinets of the type generally described for instance in U.S. Pat. Nos. 3,193,074; 3,228,506 and 3,599,770, a lock unit is inserted through a forwardly opening recess provided in a lock unit mounting post and releasably retained in mounted condition within such mounting post by operation of a custodian lock. A drawback of this type of construction is that the lock unit can be pried from within the mounting post by means of a strong bar or the like to a degree sufficient to remove the lock bolt of the lock unit from locking engagement with its associated cabinet door and thereby afford unauthorized access to stored contents of the locker cabinet.

In a variation of the above construction, which is disclosed for instance in U.S. Pat. Nos. 2,675,107; 2,707,043 and 3,460,662, a security plate(s) is removably fixed to the front of a lock unit mounting post, such as to overlie and protect the individual lock units. However, the security plate is itself susceptible to unauthorized removal by a prying operation with the result that the lock units may be exposed for tampering.

An alternative approach, which is disclosed for instance in U.S. Pat. Nos. 2,723,018; 3,249,197; 3,397,765 and 3,450,244, involves the mounting of a lock unit within a housing fixed to the rear surface of each individual cabinet door. However, typical cabinet doors are provided with a front panel fabricated from relatively light gauge sheet steel or the like, which may be readily pierced to afford access to the lock unit, while the cabinet door is in its locked condition. Another problem with this type of installation is that, when the cabinet door is unlocked, ready access is provided to the housing of the lock unit, such as to permit prying thereof from the inside of the door. While of course, the thickness of the door front panels and the housings of the lock units may be substantially increased, the additional weight involved is undesirable, since it requires that the hinges of the doors be strengthened to carry the additional weight and results in the overall cost of the cabinet being greatly increased.

SUMMARY OF THE INVENTION

The present invention is directed towards an improved arrangement for mounting a coin operated lock unit within a rental locker cabinet and for affording custodian access to a locked storage compartment of such locker cabinet. More specifically, the invention provides for removably mounting a lock unit within a lock unit mounting post through a rear surface thereof, which surface is exposed for lock unit insertion/removal purposes only when the door of an adjacent storage compartment is in an unlocked condition. The front and side surfaces of the mounting post are formed with apertures disposed for alignment with at least the key operated custodian and patron locks, the coin chute and the lock bolt of the lock unit, when disposed within the mounting post. Means under the control of a custodian lock is employed to selectively, releasably retain the lock unit in mounted condition and to control the patron lock for door unlocking/locking purposes, while the key of the patron lock is removed therefrom.

In accordance with the preferred form of the invention, the above mentioned means includes a control link serving the selectively couple the custodian lock with the cylinder housing of the patron lock, such that the latter is constrained from rotation relative to the lock unit, while the custodian lock is disposed in its normal locked condition, in order to permit normal functioning of the patron lock for lock bolt extension/retraction purposes. However, when the lock bolt is in its extended or locking condition and the patron key is removed from the patron lock and unavailable for door unlocking purposes, a custodian may gain access to the locked storage compartment by use of a custodian key to temporarily rotate the custodian lock from its normal locked condition into a lock bolt unlocking condition incident to which the patron lock cylinder housing is driven by the control link for rotation relative to the lock unit, so as to effect retraction of the lock bolt and resultant unlocking of the door. Return of the custodian lock to its normal locked condition effects return movement of the patron lock cylinder housing and resultant extension of the lock bolt for door locking purposes.

Preferably, the arrangement is such that the cylinder housing of the patron lock may be rotationally uncoupled from the custodian lock, during further rotations of the custodian lock beyond its lock bolt unlocking condition for purposes of releasing the lock unit for removal from within the mounting post.

The present construction possesses the particular advantage that it permits lock units to be enclosed within a lock unit mounting post in a manner preventing unauthorized access thereto for cabinet door unlocking purposes. Security may be enhanced by the expedient of forming the mounting post of heavier than normal steel construction without resulting in any significant increase in the overall cost of the locker cabinet. Moreover, even when the cabinet doors are in their normal opened condition, the likelihood of an authorized individual gaining access to the lock unit is substantially reduced for the reason that a security plate serving to close the lock unit insertion or access opening of the mounting post is disposed on a rearwardly facing surface thereof and thus hidden from normal observation. Even in the event that the presence of the security plate is known, its location wholly within the confines of the storage compartment, renders it practically inaccessible for prying purposes.

DRAWINGS

The nature and mode of operation of the present invention will now be more fully described in the following detailed description taken with the accompanying drawings wherein:

FIG. 1 is an exploded perspective view of a lock unit and associated mounting post;

FIG. 2 is a side elevational view of a lock unit mounted within the mounting post;

FIG. 3 is a sectional view taken generally along the line 3—3 in FIG. 2;

DETAILED DESCRIPTION

Figure 5:
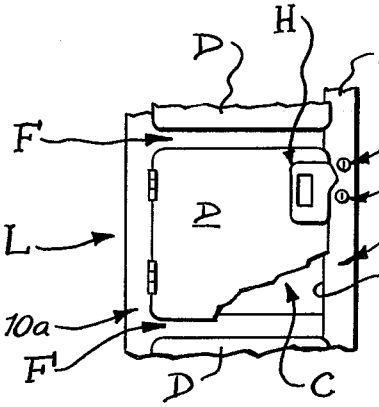
FIG. 5 is a fragmentary front elevational view of a locker cabinet embodying the present invention.

Reference is first made to FIG. 1, wherein a mounting post 10 forming a portion of the frame of a coin operated locker cabinet, and designated as "L" only in FIG. 5, is depicted in disassembled association with a coin operated lock unit 12. It will be understood that in a typical locker cabinet construction, one or more upright lock unit mounting posts 10 cooperate with each other and/or a hinge mounting post 10*a* to horizontally bound one or more columns of storage compartments "C", wherein the compartments of each column are vertically separated by horizontal frame members "F" extending between such posts. The forwardly facing access openings of the storage compartments are selectively closed by suitable doors "D", which are hingedly secured to the hinge mounting post, and to intermediate ones of the lock unit mounting posts for instances where the locker cabinet is provided with more than one column of storage compartments, and selectively and releasably secured in locked or storage compartment closed condition by associated lock units spaced vertically of each lock unit mounting post in horizontal alignment with the storage compartments.

In accordance with a preferred form of the present invention, mounting post 10 is fabricated by joining together, as by welding, front and rear, generally J-shaped, rolled steel channel members 14 and 16 to define a rigid box beam construction. For purposes of reference, front and rear channel members 14 and 16 are considered as having forwardly and rearwardly facing flange portions 14*a* and 16*a* and pairs of leg or side flange portions 14*b*, 14*c* and 16*b*, 16*c*, respectively, wherein flange portions 14*b* and 14*c* are joined in a lapped relation with flange portions 16*b* and 16*c*, respectively. Front flange portion 16*a* is intended to be exposed for view from the front of the locker cabinet and characterized as having vertically spaced groups of apertures, only one group being illustrated in the drawing, wherein each group of apertures is intended to accommodate one of lock units 12 for operative association with the door of an adjacently disposed storage compartment. Each group of apertures would preferably include custodian and patron lock locating apertures 18 and 20, respectively; a coin insertion slot 22; and a parton lock release rod receiving aperture 24. Additional apertures may be provided in each group for permitting viewing of a counter-mechanism and the return of coins, if required by the design of the lock units to be fitted within mounting post 10. Front flange 16 would also normally be provided with an opening, not shown, disposed adjacent its lower end for purposes of affording custodian access to a coin box or collecting chamber, also not shown, adapted to receive and store coins after passage thereof downwardly within the mounting post with the aid of a coin chute 26 formed, as by way of example, by welding the edges of a plate 28 to the inner surfaces of flange portions 16*a* and 16*b*.

Flange portions 14*b* and 16*b* are intended to be suitably fixed to an exterior side panel of the locker cabinet, or for the case where the locker cabinet includes more than one column of storage compartments, may serve as a part of a hinge support assembly for the doors of a next adjacent column. On the other hand, flange portions 14*c* and 16*c* of each mounting post serve to bound the access openings of an operably adjacent column of storage compartments, thereby necessitating that flange portion 14*c* be formed with lock bolt receiving slots 30 arranged one in association with each of the above described groups of apertures.

Further, by reference to FIGS. 1 and 2, it will be understood that rear flange portion 16*a* is formed with vertically elongated and generally rectangular mounting openings 32, which are provided one in association with each of the above mentioned groups of apertures or storage compartments and sized to permit removable insertion of one of lock units 12 therethrough for positioning within the confines of mounting post 10 in the manner best shown in FIG. 2. It will be understood that rear flange portion 16*a* is accessible for lock unit insertion/removal purposes from within the confines of the individual storage compartments, but nonetheless spaced substantially inwardly of the access openings of such compartments, such as to be normally obscured from view and in any event render it exceedingly difficult for unauthorized individuals to use tools, such as a pry bar, to effect removal of a lock unit from within mounting post 10 through mounting opening 32.

Figure 4:
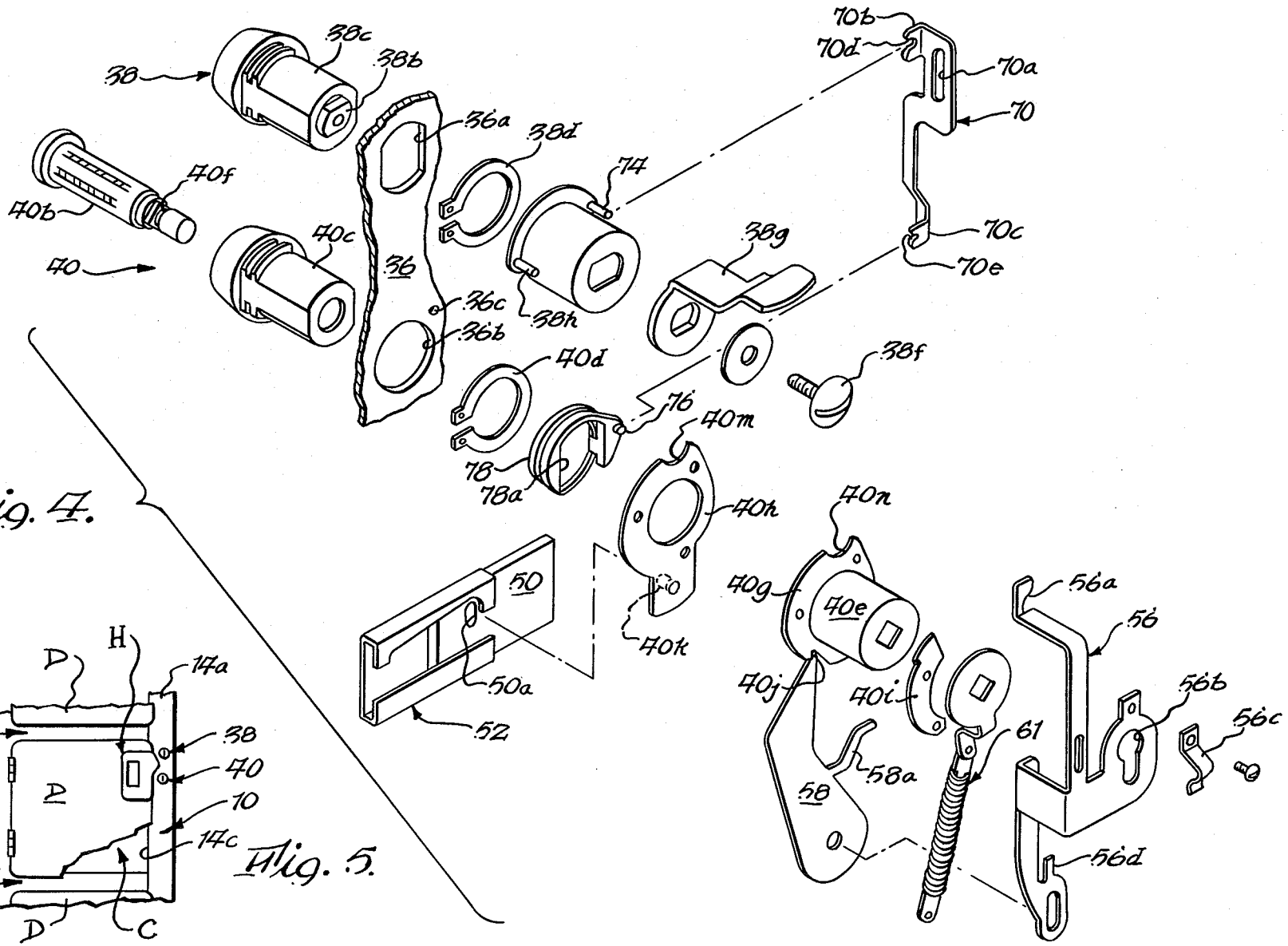
FIG. 4 is an exploded perspective view of the patron and custodian lock assemblies, the lock bolt and mechanism for operably coupling same.

By now referring to FIGS. 1, 2 and 4, it will be understood that lock unit 12 may be similar in basic construction to that described in prior U.S. Pat. Nos. 3,193,074 and 3,599,770, whose disclosures are specifically incorporated by reference herein. More specifically, the construction of lock unit 12 is conventional from the standpoint that it includes a front plate 36, which provides a frame on which all other elements comprising the lock unit may be directly or indirectly mounted. Front plate 36 is formed with apertures 36*a*, 36*b* and 36*c* for receiving a custodian lock 38, a patron lock 40 and the forward end of a spring biased patron lock release rod 42, respectively; and a coin insertion slot 36*d*, which is disposed for alignment with the upper end of a vertically extending coin chute 44 suitably defined as for instance by a side plate 46, which may be formed as an integral part of front plate 36, and an inner guide plate 48 joined to side plate 46, as by welding. Front plate 36 may also be provided with additional apertures, not shown, to permit viewing of a counter mechanism and the return of coins, if required by the design/function of lock unit 12. Side plate 46 is provided with a slot 46*a*, which is sized to freely receive a lock bolt 50, which is slideably supported by a front plate mounted bracket 52 for movements between its retracted or unlocking and extended or locking positions shown in FIGS. 1 and 3, respectively. It will be understood that when lock unit 12 is mounted within mounting post 10 in the manner to be described, apertures 36*a*, 36*b* and 36*c* are disposed in alignment with apertures 18, 20 and 24, respectively; and slots 36*d* and 46*a* are disposed for alignment with slots 22 and 30, respectively.

The construction of custodian and patron locks 38 and 40 is best shown in FIGS. 2 and 4 as being conventional from the standpoint that they generally include custodian and patron keys 38*a* and 40*a* removably insertable within tumbler supporting lock cylinders 38*b* and 40*b*, which are in turn removably supported within housings 38*c* and 40*c* having tumbler receiving slots, shown in FIG. 3, for rotation under the control of keys 38*a* and 40*a*. Housings 38*c* and 40*c* extend rearwardly through front plate apertures 36*a* and 36*b* and are retained in assembled condition therewithin by suitable spring clips 38*d* and 40*d*. Further, housings 38*c* and 40*c* serve to rotatably support generally cup-shaped barrels 38*e* and 40*e*; such barrels being keyed for rotation with the rearwardly disposed ends of lock cylinders 38*b* and 40*b*, which freely extend through the rear walls of housings 38c and 40c. Custodian lock cylinder 38b is permanently fixed within housing 38c and barrel 38e by suitable means, such as a threaded fastener 38f, whereas patron lock cylinder 40b is preferably removably retained within housing 40c and barrel 40e in the manner to be subsequently described. Further, it will be noted that housing 38c is fixed against rotation relative to face plate 36, due to the non-round configuration of mounting aperture 36a, such that key controlled rotations of lock cylinder 38b impart corresponding rotations to a latch plate 38g fixed to the rear end of the lock cylinder 38b by fastener 38f.

Custodian lock 38 and patron lock 40 are preferably operably interconnected in the manner generally disclosed in U.S. Pat. No. 3,599,770 via a control bar 56, which is supported by front plate mounted studs 56' for vertical sliding movements under the control of a custodian lock barrel mounted control pin 38 removably received within control bar recess 56a, alternately in opposite directions from an intermediate operating or first position shown in FIG. 2 and in full line in FIG. 3, into an upper or second position, shown only in broken line in FIG. 3, which permits operation of lock unit 12 in a non-pay status, or a lower or third position, not shown, which permits release of patron lock cylinder 40b for removal from within housing 40c. It will be understood that patron lock cylinder 40b is releasably/operably connected to control bar 56 by providing same with an annular groove 40f and a key shaped slot 56b, respectively. The edges of control bar 56 bounding slot 56b are received within groove 40f when the control bar is in its intermediate and upper positions, whereby to retain the patron lock cylinder assembled within its barrel, but are removable from within such groove when the control bar is in its lower position, whereby to release the patron lock cylinder and permit a control bar mounted leaf spring 56c to bias the patron lock cylinder forwardly in order to facilitate removal thereof by a custodian for purposes of repair and/or replacement. It will be noted that the above described positions of control bar 56 differ from like positions of the control bar disclosed in U.S. Pat. No. 3,599,770, due to the relatively inverted orientation of slot 56b.

Again referring to FIG. 4, it will be understood that patron lock barrel 40e may be conventional from the standpoint that its rim portion 40g is fixed to plates 40h and 40i, which cooperate to guide the upper end of a pivotally supported pawl or operation constraining device 58 normally biased by a spring, not shown, for engagement with one or more teeth 40j defined by rim portion 40g. Further, plate 40h is fitted with a pin 40k, which is sized to be rotatably and slidably received within a slot 50a formed in lock bolt 50; and plate 40h and rim portion 40g are formed with aligned, edge opening recesses 40m and 40n sized to removably receive an enlarged catch portion 42a carried by patron lock release rod 42.

Pawl 58 is shown in FIG. 4 as being formed with a sensing finger 58a whose purpose is to control the pivotal position of pawl 58 relative to teeth 40j in response to the depositing of coins within coin chute 44. In prior lock constructions of the type disclosed in U.S. Pat. Nos. 3,193,074 and 3,599,770, sensing finger 58a is arranged and biased to project through an opening provided in coin chute 44 for engagement with coins, when same are releasably retained in a sensing position by a coin interceptor or gauging mechanism, not shown. In the illustrated construction, sensing finger 58a is arranged to engage with a portion of an improved coin counter mechanism 59, which is movable in response to the passage of properly sized coins downwardly through the coin chute 44. Mechanism 59 forms no part of the present invention, but rather is the subject matter of a commonly assigned patent application, entitled RACHET ESCAPEMENT COIN COUNTER, which names Messrs. Douglas Barth and Richard Chester, as joint inventors and is incorporated by reference herein. However, it will be understood that in both types of construction, the purpose of sensing finger 58a, or its equivalent, is the same, namely, preventing pawl 58 from undergoing pivotal movements into engagement with teeth 40j, upon the depositing of the required number of coins of a given denomination within coin chute 44. This serves to free patron lock 40 for purposes of effecting movement of locking bolt 50 under the control of key 40a into its projecting or locking position, wherein it operably engages with the door of an adjacently disposed storage compartment. The construction of patron lock cylinder 40b and housing 40c is such as will permit removal of key 40a from within the lock cylinder only upon rotation thereof into its lock bolt extended or locked position.

Operation of patron lock 40 in the above described manner is typically prevented until its associated door is moved into its fully closed position, wherein the door or a portion of its handle "H" serves to depress patron lock release rod 42 sufficiently to remove catch 42a from within recesses 40m and 40n. Patron lock 40 may be operated in the non-pay status or condition mentioned above by operation of custodian lock 38 to lift control bar 56 into its upper position shown in broken line in FIG. 3, wherein its lower tab portion 56d engages with sensing finger 58a and thereby serves to constrain pawl 58 against spring biased pivotal movement into engagement with teeth 40j, as an incident to rotation of barrel 40e towards its lock bolt extended position.

If desired, lock unit 12 may also be fitted with a conventional spring biased over-center control device 61 adapted to bias lock bolt 50 alternately into its locked and unlocked positions incident to operation of patron lock 40.

In accordance with the present invention, the construction of lock unit 12 departs in several important aspects from prior units of the type described for instance in U.S. Pat. Nos. 3,193,074 and 3,599,770. Specifically, the present invention contemplates that lock unit 12 be sized for insertion into mounting post 10 through an associated mounting opening 32 to position its front plate 36 in abutting engagement with the rearwardly facing surface of flange portion 14a and that latch plate 38g be shaped and sized to extend rearwardly of the lock unit for removable engagement with the forwardly facing surface of flange portion 16a for releasably retaining the lock unit in its mounted position best shown in FIG. 2. Thus, in these respects, the present lock unit is to be distinguished from prior lock units of the type mentioned above, wherein such lock units are intended to be inserted through an opening provided in the front flange portion of a mounting post and their associated front plate and latch plate are intended to removably engage with forwardly and rearwardly facing surfaces, respectively, of such flange portion.

Further, in accordance with the present construction, side plate 46 is provided with generally L-shaped, upper and lower mounting flanges 62 and 64, which are formed integrally with and extend transversely from adjacent the rear edge of the side plate. Mounting flanges 62 and 64 include transversely extending coplanar flange portions 62*a* and 64*a*, which serve to support a vertically extending closure or security plate 66; and coplanar end tabs 62*b* and 64*b*, which are disposed essentially parallel to side plate 46 and cooperate therewith to positionally locate the rear of the lock unit transversely within mounting opening 32 by loose sliding engagement with its opposite vertically extending side edges 32*a* and 32*a*. It will be noted by reference to FIGS. 1, 2 and 3 that lower end tab 64*b* and a tab 46*b*, which is formed as part of side plate 46, project below the side plate and cooperate with an L-shaped flange 66*a* formed integrally with the lower end of closure plate 66 to define a retaining or mounting lip arranged to engage the forwardly facing surface of flange portion 16*a* adjacent the lower edge 32*b* of mounting opening 32; the lower end of the closure plate being spaced from lower edge 32*b* sufficiently to provide clearance for insertion of lock unit 12. It will also be noted that when the latch plate 38*g* is disposed in engagement with rear flange portion 16*a*, as best shown in FIG. 2, front plate 36 is forced to engage front flange portion 14*a*, such that the forward ends of lock housings 38*c* and 40*c* are seated within apertures 36*a* and 36*b* and serve to positionally support lock unit 12 vertically within mounting post 10. As will be apparent from FIGS. 1 and 2, closure plate 66 is sized to bridge transversely across side edges 32*a* and vertically across an upper edge 32*c* of opening 32, for seated engagement with the rearwardly disposed surface of rear flange portion 16*a*, when lock unit 12 is mounted within mounting post 10 and latch 38*g* is engaged with the front surface of such rear flange portion.

The present invention additionally contemplates the coupling of custodian lock 38 to patron lock 40 in a manner permitting a custodian to selectively control the patron lock for door unlocking/locking purposes in order to gain access to a locked storage compartment, while patron key 40*a* is removed from the patron lock and either in the possession of a patron or otherwise unavailable for door unlocking purposes, due for instance to its being lost or damaged. Specifically, locks 38 and 40 are coupled by means of an actuating plate or arm 70, which is supported for vertically sliding movements within lock unit 12 is engagement with inner guide plate 48 by an inner guide plate mounted guide pin 72 slidably received within a vertically extending slot 70*a* formed in the actuating plate. The upper and lower ends of actuating plate 70 are provided with coupling flanges 70*b* and 70*c*, which serve to define side opening slots 70*d* and 70*e* sized to removably/slidably receive coupling pins 74 and 76 carried by custodian lock barrel 38*e* and a patron lock control member, such as a ring or collar 78, respectively. It will be understood by reference to FIG. 4, that control ring 78 has a through opening 78*a* sized and shaped to permit the control ring to be non-rotatably fixed to or mounted on patron lock housing 40*c*, and aperture 36*b* is of circular configuration in order to provide a bearing support for the patron lock housing. This construction is to be distinguished from conventional lock unit constructions, wherein aperture 36*b* is of a non-circular configuration, such as that illustrated in the case of aperture 36*a*, and serves to fix patron lock housing 40*c* against rotation relative to front plate 36, and thus the lock unit as a whole.

Reference is now made to FIG. 3, wherein the elements of lock unit 12 are shown in full line in the positions they assume when the lock unit is in its locked condition and keys 38*a* and 40*a* are removed from their associated locks. It will be noted that actuating plate 70 is in its normal operating or upper position with pins 74 and 76 received within their associated slots 70*d* and 70*e*, whereby patron lock housing 40*c* is constrained against rotation or fixed in a first or normal operating position thereof, due to the locked condition of custodian lock 38. Also, it will be noted that control bar 56 is shown as being disposed in its intermediate position.

As in conventional constructions, lock unit 12 may be returned to its normal unlocked condition by inserting patron key 40*a* into patron lock cylinder 40*b* and effecting return rotation thereof into its unlocked condition for purposes of returning lock bolt 50 to its retracted/unlocked position shown in broken line. Unlike conventional constructions, lock bolt 50 may also be returned to its retracted/unlocked condition without use of patron key 40*a*. This is accomplished by use of custodian key 38*a* to temporarily unlock custodian lock 38 and effect clockwise directed rotations thereof into its unlocking position, wherein its associated parts are shown in broken line in FIG. 3 and designated by primed numbers. Unlocking rotations of custodian lock 38 results in downwardly directed vertical movement of actuating plate 70 into its unlocking position, which is also illustrated in broken line in FIG. 3 and has its parts designated by primed numbers. Downward movement of actuating plate 70 effects a clockwise directed rotational movement of patron lock housing 40*c* into a second or unlocking position thereof and thus a corresponding rotational movement of patron lock barrel 40*e* into its unlocked position for purposes of moving lock bolt 50 into its retracted/unlocked position; it being understood that barrel 40*e* is keyed or coupled for rotation with housing 40*c* by patron lock cylinder 40*b*, whenever patron key 40*a* is withdrawn from the patron lock, as in the case of conventional patron lock constructions. Unlocking of lock unit 12 in this manner permits custodian access to a locked storage compartment for purposes of inspection, removal of overtime stored packages and removal of the lock unit. If lock unit 12 has been unlocked simply for storage compartment inspection or package removal purposes, the custodian may return same to its initial locked condition by employing custodian key 38*a* to return custodian lock 38 to its normal locked position shown in full line in FIG. 3, incident to which lock bolt 50 is returned to its extended/locked position.

By again making reference to FIG. 3, it will be understood that control bar 56 is lifted into its upper position or non-pay status, as an incident to clockwise directed rotations of custodian lock 38 for purposes of effecting retraction of lock bolt 50 into its retracted/unlocking position, and that the control bar is not returned to its normal intermediate position until return or counterclockwise directed rotations of the custodian lock have effected extension or return of the lock bolt to its extended/locking position. Thus, tab portion 56*d* of control bar 56 is arranged for engagement with sensing finger 58*a* in order to prevent pawl 58 from interfering with return movement of lock bolt 50 into its extended/locking position under the control of custodian lock 38. This arrangement is required when the present invention is incorporated in lock units, such as those disclosed in U.S. Pat. Nos. 3,193,074 and 3,599,770, which are characterized in that a coin sensing finger or the like again becomes operative, as an incident to movement of a lock bolt into an extended/locking position or removal of a patron key, for preventing any subsequent extension of the lock bolt, once same has been returned to its retracted/unlocking position, until coins are again deposited in a coin chute for sensing purposes.

If a custodian desires to remove lock unit 12 from within mounting post 10 for any reason, he would simply continue rotation of the custodian key 38*a* past the above described unlocking position of custodian lock 38 until its parts assume an alternative locking or lock unit remove/insertion position shown in broken line and designated by double primed numbers in FIG. 3, wherein such parts are displaced through 180° from the positions they assume when the custodian lock is in its normal latching position illustrated in full line in FIGS. 1-3. Operation of custodian lock 38 to effect rotation of its parts through 180° serves both to remove latch plate 38*g* from latching engagement with rear flange portion 16*a* and to place the custodian lock in an alternative locked condition permitting removal of custodian key 38*a*, thereby to free lock unit 12 for removal through opening 32. Thus, custodian lock 38 is to be distinguished from prior commercial lock unit constructions, wherein its housing 38*c* correspond in design to that of patron lock housing 40*c* and permit removal of key 38*a* in only one rotatable position of its cylinder 38*b* corresponding to its normal latching position shown in full line in FIG. 3. In the present arrangement, the otherwise conventional tumblers carried by custodian lock cylinder 38*b* and/or the tumbler accommodating slots provided in housing 38*c* and sized to permit insertion/-withdrawal of key 38*a* in two rotative positions of cylinder 38*b* relative to housing 38*c*, which are spaced apart through 180°. Reference may be made to U.S. Pat. No. 3,754,422 for a disclosure of lock barrel and housing constructions suitable for use in forming custodian lock 38 when modified to provide a pair of equal sized tumbler receiving slots spaced apart through 180°.

As will be apparent from viewing FIG. 2, the relative sizing of lock unit 12 and mounting post 10 is such as to require the removal of both of keys 38*a* and 40*a* in order to provide sufficient clearance for lock unit removal/insertion through mounting opening 32. It will also be apparent from viewing FIG. 3 that pin 74 is withdrawn from within the confines of slot opening 70*d* incident to rotation of custodian lock 38 between its unlocking position and its alternate locked condition described above in order to temporarily uncouple the custodian and patron locks and permit actuating plate 70 to remain in its lowered position, also shown in broken line in FIG. 3. Upon counterclockwise rotations of custodian lock 38 from its alternative locked condition, pin 74 is again seated within slot opening 70*d* to again operably couple the custodian and patron locks and eventually return actuating plate 70 to its uppermost position and, as an incident thereto, effect return of lock bolt 50 to its projecting/locked position, both shown in full line in FIG. 3.

When the door of a storage compartment is unlocked such as to afford a custodian access to the rear of flange portion 16*a*, lock unit 10 may be installed in mounting post 10 through its associated one of mounting openings 32 by the following procedure. Prior to installation, it is necessary that lock bolt 50 be disposed in its retracted position, that latch plate 38*g* be disposed in its lock unit removal/insertion position designated by double primed number in FIG. 3, and that, for the case of the illustrated construction of mounting post 10 and lock unit 12, keys 38*a* and 40*a* be removed in order to provide sufficient clearance to allow insertion of the lock unit through its associated opening 32 and positioning or seating thereof within the mounting post, as best shown in FIG. 2. As desired, patron key 40*a* may simply be removed from cylinder 40*b* or both the patron key and its cylinder may be removed from lock unit 12 prior to installation. After installation of lock unit 12, custodian key 38*a* is inserted and then operated to move the elements of custodian lock 38 in a counterclockwise fashion, as viewed in FIG. 3, until they assume their normal locked position shown in full line in FIGS. 2 and 3, wherein latch plate 38*g* is disposed in abutting engagement with the forwardly facing or inner surface of rear flange portion 16*a* with the result that security plate 66 is drawn against the rearwardly facing or outer surface of such rear flange portion in order to securely fix the lock unit within mounting post 10. For the case where patron key 40*a* was removed from cylinder 40*b* prior to the mounting of lock unit 10, lock bolt 50 will be extended into its locked condition incident to operation of custodian key 38*a* in the manner described above. Then, upon removal of custodian key 38*a* and subsequent insertion and operation of patron key 38*a* for purposes of retracting lock bolt 50, the patron key will be automatically retained within its cylinder and lock unit 12 placed in condition for subsequent coin operation. If on the other hand, both patron key 38*a* and its cylinder were removed as a unit from lock unit 12 prior to mounting thereof, lock bolt 50 would remain in its retracted position and control ring 78 and housing 40*c* simply undergo rotational movements within barrel 40*e* incident to operation of custodian key 38*a* for lock unit mounting purposes. Then, before removal of custodian key 38*a*, it would be necessary to continue counterclockwise directed rotational movements thereof, as viewed in FIG. 3, until control bar 56 has been moved into its lowermost position in order to place the enlarged upper end of slot 56*b* in position to receive the rear end of patron lock cylinder 40*b*, when the latter with key 40*a* positioned therewithin is fully inserted into housing 40*c*. As is conventional, patron lock cylinder 40*b* would be inserted within housing 40*c* to assure its normal lock unit unlocked position, such as to prevent removal of patron key 40*a*, until such time as the lock unit is subsequently operated under coin control to extend lock bolt 50 into its extended/locked position. After insertion of lock cylinder 40*b*, custodian key 38*a* would be employed to return custodian lock 38 to its normal locked position, and as an incident thereto raise control bar 56 into its intermediate position for purposes of retaining lock cylinder 40*b* in its inserted condition. Finally, upon removal of custodian key 40*a*, lock unit 12 is in condition for subsequent coin operation. It will be understood that, during rotations of custodian key 38*a* for porposes of moving control bar 56 in the manner described above, coupling pin 74 is removed from within its associated slot 70*d* and actuating plate 70 thereby permitted to remain stationary in its normal upper position shown in full line in FIG. 3. It will also be understood that lock unit 12 may be removed from within mounting post 10 by reversing the steps described above in connection with either of these alternative mounting procedures. Thus, with the present construction, lock unit 12 may be removed from within mounting post 10 regardless of whether the lock unit is in an unlocked or locked condition at the time removal thereof is desired.

I claim:

1. A coin operated lock unit adapted for installation in a locker cabinet for use in releasably locking a door associated with a storage compartment of said locker cabinet in a closed condition, said lock unit comprising in combination:

a frame;

a coin chute supported by said frame;

a patron key operated patron lock having a patron lock housing supported by said frame for rotation relative thereto between first and second positions, a patron lock cylinder supported for rotation within said patron lock housing, a patron lock barrel supported for rotation by said patron lock housing and keyed for rotation with said patron lock cylinder, said patron lock key being removably insertable within said patron lock cylinder when said patron lock cylinder and barrel occupy a locked position and said patron lock housing is in said first position thereof, said patron lock cylinder and housing being fixed against relative rotation when said patron lock key is removed from said patron lock cylinder, and said patron lock key when inserted within said patron lock cylinder and said patron lock housing is in said first position thereof being operable to effect rotation of said patron lock cylinder and barrel relative to said patron lock housing between said locked and an unlocked position thereof;

a custodian key operated custodian lock having a custodian lock housing non-rotatably supported by said frame, a custodian lock cylinder supported for rotation within said custodian lock housing, a custodian lock barrel supported for rotation by said custodian lock housing and being keyed for rotation with said custodian lock cylinder, said custodian key being removably insertable within said custodian lock cylinder when said custodian lock cylinder and barrel are disposed in a locked position thereof and when inserted being operable to effect rotations of said custodian lock cylinder and barrel relative to said custodian lock housing between said locked position and an unlocked position thereof;

a lock bolt supported by said frame for movement between extended/locking and retracted/unlocking positions;

means coupling said lock bolt to said patron lock barrel for effecting movement thereof between said extended/locking and retracted/unlocking positions incident to rotation of said patron lock barrel between said locked and unlocked positions thereof, respectively;

constraining means for normally constraining said patron lock barrel against rotation from said unlocked towards said locked position thereof;

means responsive to depositing of coins in said coin chute for preventing operation of said constraining means;

additional means for coupling said custodian lock barrel to said constraining means for preventing operation thereof incident to movement of said custodian lock barrel between said unlocking and locked positions thereof; and means for coupling said custodian lock barrel to said patron lock housing for maintaining said patron lock housing in said first position when said custodian lock barrel is in said locked position thereof and upon rotation of said custodian lock barrel between said locked and unlocking positions thereof for effecting rotation of said patron lock housing between said first and second positions thereof with resultant rotations of said patron lock barrel between said locked and unlocked positions thereof and movement of said lock bolt between said extended/locking and said retracted/unlocking positions, while said patron lock key is removed from said patron lock cylinder.

2. A lock unit according to claim 1, wherein said means for coupling said custodian lock barrel to said patron lock housing includes a control member fixed for rotation with said patron lock housing, actuating means slidably supported by said frame for movement between an operating position and an unlocking position and means for movably connecting said custodian lock barrel and said control member to opposite ends of said actuating means, whereby when said custodian lock barrel is in said locked position thereof, said actuating means is in said operating position and said patron lock housing is fixed in said first position and when said custodian lock barrel is moved into said unlocking position thereof, said actuating means is moved into said unlocking position thereof to effect rotation of said patron lock housing into said second position.

3. A lock unit according to claim 2, wherein said additional means includes a control means slidably supported by said frame for movement between first and second positions, said control means engaging with said constraining means for preventing operation thereof when in said second position thereof and being removed from engagement with said constraining means when in said first position thereof, and said custodian lock barrel is movably connected to said control means to effect movement thereof between said first and second positions thereof incident to movement of said custodian lock barrel between said locking and unlocking positions thereof.

4. A lock unit according to claim 3, wherein a latch plate for releasably latching said lock unit in a mounted condition within said locker cabinet is fixed for rotation with said custodian lock barrel, said latch plate assuming a locked position when said custodian lock barrel is in said locked position thereof, said custodian lock barrel being rotatable in a direction past said unlocking position thereof into a alternate locked position wherein said latch plate is disposed in an unlocked position and said custodian key may be removably inserted within said custodian lock cylinder, said custodian lock barrel being uncoupled from said control means and said actuating means incident to rotation thereof intermediate said unlocking and alternate locking positions.

5. A lock unit according to claim 4, wherein said frame includes a front plate and a side plate extending rearwardly of said front plate, said front plate supporting said lock bolt, said custodian lock housing, said patron lock housing, said constraining means and said control means, said side plate supporting said coin chute and said actuating means, and there is further provided in combination a security plate disposed rearwardly of said front plate and fixed to extend transversely of said side plate, and said latch plate extends rearwardly of said front plate towards said security plate and cooperates therewith to releasably retain said lock unit within said locker cabinet when said custodian lock barrel is disposed in said locked position thereof.

6. In a locker cabinet of the type having a coin operated lock unit removably mounted within a mounting post bounding in part an access opening of a storage compartment, said lock unit including a patron key operated patron lock, a custodian key operated custodian lock, a coin chute, a lock bolt movable under the control of said patron lock between a retracted/unlocked position and an extended/locking position, wherein said lock bolt is adapted to lock a door associated with said access opening of said storage compartment in closed condition, constraining means for normally constraining said patron lock from effecting movement of said lock bolt from said retracted/unlocked position into said extended/locking position, and means responsive to insertion of coins within said coin chute for preventing operation of said constraining means whereby to free said patron lock for operation by said patron key for purposes of moving said lock bolt between said retracted/unlocked and said extended/-locking positions, whereupon said patron key may be removed from said patron lock, the improvement comprising in combination:

means for coupling said custodian lock to said patron lock for effecting movement of said lock bolt between said extended/locking and retracted/unlocked positions, while said patron key is removed from said patron lock.

7. An improvement according to claim 6, wherein additional means are provided to couple said custodian lock to said constraining means for preventing operation thereof, when said custodian lock is coupled to said patron lock for purposes of effecting movement of said lock bolt from said retracted/unlocked position into said extended/locking position.

8. An improvement according to claim 6 or 7, wherein said mounting post includes front, rear and at least one connecting side flange portion, said side flange portion bounding in part said access opening, said front flange portion being accessible from without said locker cabinet and said rear flange portion being accessible from within said storage compartment, said rear flange portion having an opening therethrough sized to permit insertion of said lock unit into a mounted position within said mounting post, said front flange portion having apertures cooperating with said custodian and patron locks to positionally support said lock unit in said mounted position and afford access by said custodian and patron keys for operation of said custodian and patron locks and a coin insertion slot disposed for alignment with said coin chute when said lock unit is in said mounted position, said side flange portion having a slot sized to permit movement of said lock bolt therethrough between said retracted/unlocked and extended/locking positions when said lock unit is in said mounted position; and said lock unit additionally includes a security plate arranged to bridge across said opening of said rear flange portion rearwardly thereof, when said lock unit is in said mounted position, and a latch plate carried by said custodian lock for movement between latched and unlatched positions, and said latch plate when in said latched position cooperating with said rear flange portion to maintain said lock unit in said mounted position.

9. An improvement according to claim 6 or 7, wherein said mounting post is formed with a mounting opening accessible from within the confines of said storage compartment and sized to permit insertion of said lock unit into said mounting post to assume a mounted position therewithin, apertures to afford custodian and patron key access to said custodian and patron locks, a slot to permit insertion of coins within said mounting post for receipt within said coin chute and a slot to permit movement of said lock bolt through said mounting post between said positions thereof; and said lock unit additionally includes a latch plate under the control of said custodian lock for releasably retaining said lock unit in said mounted position.

* * * * *